US006893549B2

(12) United States Patent
Chou et al.

(10) Patent No.: US 6,893,549 B2
(45) Date of Patent: May 17, 2005

(54) CLEANING APPARATUS FOR ECMD ANODE PAD

(75) Inventors: Shih-Wei Chou, Taipei (TW); Minghsng Tsai, Taipei (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 292 days.

(21) Appl. No.: 10/266,045

(22) Filed: Oct. 7, 2002

(65) Prior Publication Data

US 2004/0065549 A1 Apr. 8, 2004

(51) Int. Cl.[7] ..... C25D 5/48; A47L 7/00; B08B 5/04

(52) U.S. Cl. ..... 205/93; 205/705; 205/709; 205/722; 205/723; 15/300.1; 134/21

(58) Field of Search ..... 205/93, 705, 709, 205/722, 723; 15/300.1; 134/21

(56) References Cited

U.S. PATENT DOCUMENTS 3,874,022 A * 4/1975 Wogoman et al. ..... 134/21

* cited by examiner

*Primary Examiner*—Robert R. Koehler
(74) *Attorney, Agent, or Firm*—Tung & Associates

(57) ABSTRACT

A cleaning apparatus for an ECMD anode pad including a vacuum head which applies vacuum pressure to the surface of the anode pad between ECMD operations in order to remove particles precipitated onto the surface of the anode pad and prevent or minimize inadvertent scratching or peeling of a wafer supported by the pad during the process. The particles are dislodged from the anode pad and removed from the ECMD system by flow of electrolyte solution into the vacuum head. The electrolyte solution is typically filtered before returning to the electrolyte tank for ultimate redistribution to the ECMD system.

16 Claims, 2 Drawing Sheets

CLEANING APPARATUS FOR ECMD ANODE PAD

FIELD OF THE INVENTION

The present invention relates to electrochemical mechanical deposition (ECMD) systems used in the deposition of metal layers on semiconductor wafer substrates in the fabrication of semiconductor integrated circuits. More particularly, the present invention relates to a cleaning apparatus which removes potential wafer-scratching or peeling particles from the anode pad of an ECMD system and significantly prolongs the lifetime of the anode pad.

BACKGROUND OF THE INVENTION

In the fabrication of semiconductor integrated circuits, metal conductor lines are used to interconnect the multiple components in device circuits on a semiconductor wafer. A general process used in the deposition of metal conductor line patterns on semiconductor wafers includes deposition of a conducting layer on the silicon wafer substrate; formation of a photoresist or other mask such as titanium oxide or silicon oxide, in the form of the desired metal conductor line pattern, using standard lithographic techniques; subjecting the wafer substrate to a dry etching process to remove the conducting layer from the areas not covered by the mask, thereby leaving the metal layer in the form of the masked conductor line pattern; and removing the mask layer typically using reactive plasma and chlorine gas, thereby exposing the top surface of the metal conductor lines. Typically, multiple alternating layers of electrically conductive and insulative materials are sequentially deposited on the wafer substrate, and conductive layers at different levels on the wafer may be electrically connected to each other by etching vias, or openings, in the insulative layers and filling the vias using aluminum, tungsten or other metal to establish electrical connection between the conductive layers.

Deposition of conductive layers on the wafer substrate can be carried out using any of a variety of techniques. These include oxidation, LPCVD (low-pressure chemical vapor deposition), APCVD (atmospheric-pressure chemical vapor deposition), and PECVD (plasma-enhanced chemical vapor deposition). In general, chemical vapor deposition involves reacting vapor-phase chemicals that contain the required deposition constituents with each other to form a nonvolatile film on the wafer substrate. Chemical vapor deposition is the most widely-used method of depositing films on wafer substrates in the fabrication of integrated circuits on the substrates.

Due to the ever-decreasing size of semiconductor components and the ever-increasing density of integrated circuits on a wafer, the complexity of interconnecting the components in the circuits requires that the fabrication processes used to define the metal conductor line interconnect patterns be subjected to precise dimensional control. Advances in lithography and masking techniques and dry etching processes, such as RIE (Reactive Ion Etching) and other plasma etching processes, allow production of conducting patterns with widths and spacings in the submicron range. Electrodeposition or electroplating of metals on wafer substrates has recently been identified as a promising technique for depositing conductive layers on the substrates in the manufacture of integrated circuits and flat panel displays. Such electrodeposition processes have been used to achieve deposition of the copper or other metal layer with a smooth, level or uniform top surface. Consequently, much effort is currently focused on the design of electroplating hardware and chemistry to achieve high-quality films or layers which are uniform across the entire surface of the substrates and which are capable of filling or conforming to very small device features. Copper has been found to be particularly advantageous as an electroplating metal.

Electroplated copper provides several advantages over electroplated aluminum when used in integrated circuit (IC) applications. Copper is less electrically resistive than aluminum and is thus capable of higher frequencies of operation. Furthermore, copper is more resistant to electromigration (EM) than is aluminum. This provides an overall enhancement in the reliability of semiconductor devices because circuits which have higher current densities and/or lower resistance to EM have a tendency to develop voids or open circuits in their metallic interconnects. These voids or open circuits may cause device failure or burn-in.

Electrochemical mechanical deposition (ECMD) is a technique which has been developed recently for plating a conductive material on a semiconductor wafer or workpiece surface. One goal of ECMD is to uniformly fill holes and trenches on the wafer/workpiece surface with the conductive material while maintaining the planarity of the surface. A typical conventional ECMD system is shown schematically in FIG. 1. The ECMD system 10 includes a anode assembly 12, having a top plate 14 removably mounted on a bottom plate 16. A typically copper anode 18 is contained in the anode assembly 12 with a supply of electrolyte solution (not shown). An anode pad 20, typically having multiple pores 21 extending therethrough, is provided on the top plate 14. A semiconductor wafer 24 is positioned face-down on the anode pad 20, with the backside 26 of the wafer 24 facing upwardly.

During the ECMD process, a conductive material, such as copper from the typically copper anode 18, is applied in holes, trenches and/or other desired areas on the wafer 24 using an electrolyte solution (not shown) in the anode assembly 12. The electrolyte solution flows from the anode 18 and through the top plate 14 and the pores 21 of the anode pad 20, respectively, where the copper cations from the anode 18 are reduced to form a copper deposit on the wafer 24. One of the problems inherent in the conventional ECMD system 10 is that particles 22 frequently precipitate on the top surface of the anode pad 20. These particles 22 tend to scratch or peel the wafer 24 upon movement of the wafer 24 on the anode pad 20 during the ECMD process, as well as upon initial positioning or eventual removal of the wafer 24 on or from the anode pad 20.

Accordingly, an object of the present invention is to provide an apparatus for removing particles from an anode pad in an electroplating system.

Another object of the present invention is to provide a method for removing particles from an anode pad in an ECMD system.

Another object of the present invention is to provide an apparatus for preventing or minimizing inadvertent scratching or peeling of semiconductor wafers in an ECMD system.

Still another object of the present invention is to provide an apparatus for prolonging the lifetime of an anode pad in an ECMD system.

Yet another object of the present invention is to provide an apparatus which dislodges and removes particles from an anode pad after an ECMD process.

A still further object of the present invention is to provide an apparatus which utilizes a vacuum force alone or in combination with a scrubbing action to dislodge and remove particles from an anode pad after an ECMD process.

Yet another object of the present invention is to provide an in-situ apparatus for low-pressure conditioning of an anode pad in an ECMD system and dislodging and removing particles from the anode pad.

Another object of the present invention is to provide an insitu apparatus which utilizes a vacuum-induced high-pressure electrolyte spray to remove particles from an anode pad in an ECMD system.

A still further object of the present invention is to provide an apparatus for maintaining an electrolyte solution for an ECMD system in a substantially low-particle, clean condition.

Yet another object of the present invention is to provide an apparatus which has no effect on the throughput of semiconductor wafers processed in a facility.

SUMMARY OF THE INVENTION

In accordance with these and other objects and advantages, the present invention comprises a cleaning apparatus for an ECMD anode pad including a vacuum head which applies vacuum pressure to the surface of the anode pad between ECMD operations in order to remove particles precipitated onto the surface of the anode pad and prevent or minimize inadvertent scratching or peeling of a wafer supported by the pad during the process. The particles are dislodged from the anode pad and removed from the ECMD system by flow of electrolyte solution into the vacuum head. The electrolyte solution is typically filtered before returning to the electrolyte tank for ultimate redistribution to the ECMD system.

The vacuum head may be used alone for dislodging and removing the particles from the anode pad. Alternatively, the vacuum head may be fitted with a brush for enhancing dislodging of the particles from the anode pad as the vacuum head removes the dislodged particles from the ECMD system. Furthermore, the vacuum head may be mounted for repeated movement, as necessary, across the surface of the anode pad to dislodge and remove the particles from the entire surface area of the anode pad.

The present invention further comprises a method for removing particles from an anode pad in an ECMD system, which method includes providing a vacuum head in sufficient proximity to the anode pad to remove particles from the anode pad responsive to operation of a pump connected to the vacuum head. The invention may further comprise providing a brush on the vacuum head to further promote dislodging and removal of the particles from the anode pad. The invention may further comprise moving the vacuum head over the surface of the anode pad as the particles are removed therefrom. The invention may further include providing a filter in communication with the vacuum head to filter the dislodged and removed particles from the electrolyte solution. Vacuum pressure applied to the anode pad through the vacuum head may range typically from about 50 p.s.i. to about 200 p.s.i.

BRIEF DESCRIPTION OF THE DRAWINGS

The invention will now be described, by way of example, with reference to the accompanying drawings, wherein.

DESCRIPTION OF THE PREFERRED EMBODIMENTS

Figure 1:
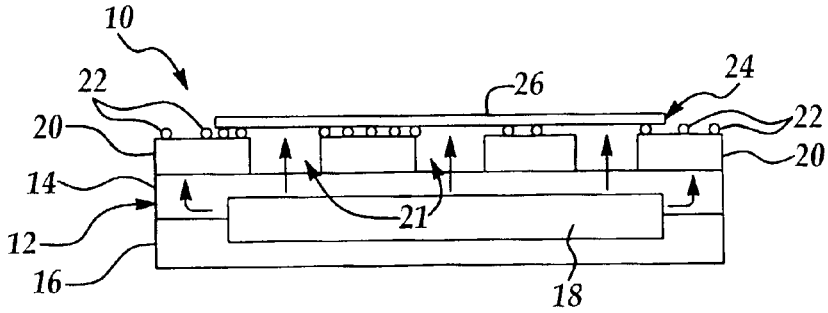
FIG. 1 is a schematic view of a typical conventional electrochemical mechanical deposition (ECMD) system.
Figure 2:
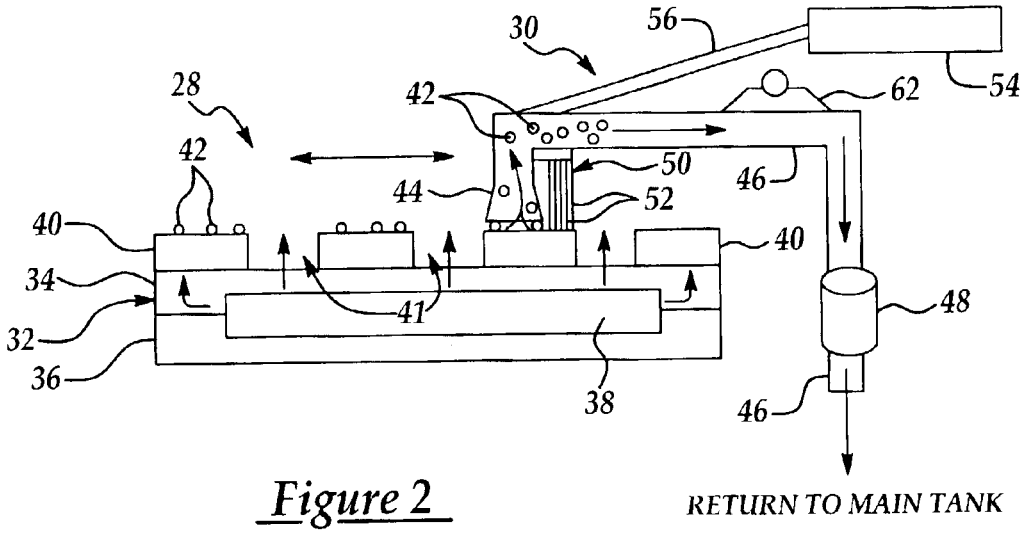
FIG. 2 is a schematic view of an ECMD system in implementation of an illustrative embodiment of the present invention.
Figure 3:
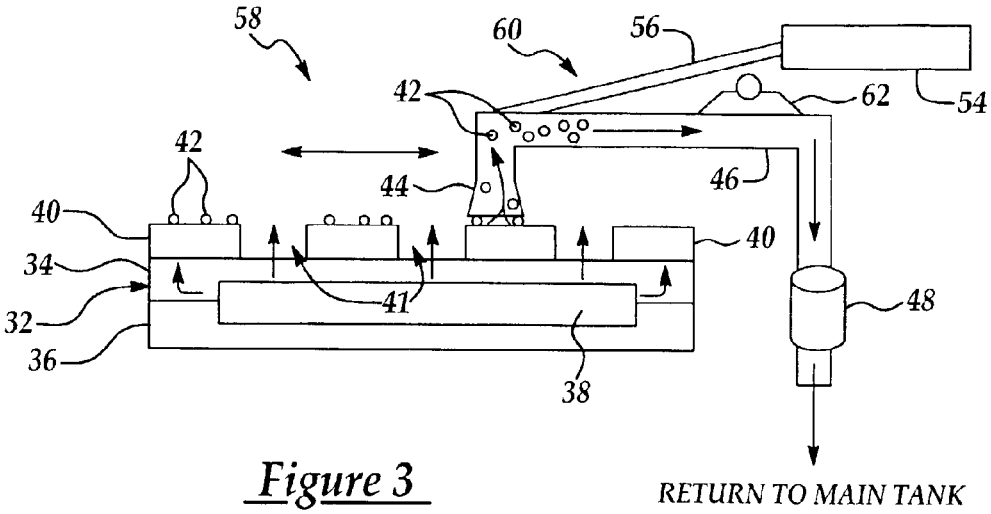
FIG. 3 is a schematic view of an ECMD system in implementation of another illustrative embodiment of the present invention.

Referring to FIGS. 2 and 3, an illustrative embodiment of the cleaning apparatus of the present invention is generally indicated by reference numeral 30 and is designed to dislodge and remove precipitate particles 42 from an anode pad 40 after an ECMD process is carried out in an ECMD system 28. The ECMD system 28 may include an anode assembly 32, having a top plate 34 removably mounted on a bottom plate 36; a copper anode 38 contained in the anode assembly 32; and an anode pad 40 having multiple pores 41 provided on the top plate 34. However, it is understood that the cleaning apparatus 30 of the present invention is equally applicable to removing particles from an anode pad 40 in a variety of electroplating applications. Before an ECMD process is carried out in the ECMD system 28, a wafer (not illustrated) is positioned face-down on the anode pad 40, with the backside of the wafer facing upwardly, as heretofore described with respect to the conventional ECMD system 10 of FIG. 1. A conductive material, such as copper from the typically copper anode 38, is applied to the wafer using an electrolyte solution (not shown) in the anode assembly 32. As indicated by the vertical arrows, the electrolyte solution flows from the anode 38 and through the top plate 34 and the pores 41 of the anode pad 40, respectively, where the copper cations from the anode 38 are reduced to form a copper layer or other deposit on the wafer. During the ECMD process, particles 42 of reduced copper cations typically precipitate on the top surface of the anode pad 40. Accordingly, these particles 42 must be removed from the wafer between ECMD processes in order to prevent scratching or peeling of the wafer upon inadvertent movement of the wafer on the anode pad 40 during the ECMD process, as well as upon initial positioning of the wafer on the anode pad 40 prior to the ECMD process or removal of the wafer from the anode pad 40 after the ECMD process.

The cleaning apparatus 30 of the present invention includes a vacuum head 44 which may be positioned directly above the upper surface of the anode pad 40. The vacuum head 44 is connected to a vacuum conduit 46, which may be flexible rubber or plastic tubing to permit extension and retraction of the vacuum head 44 over and away from, respectively, the surface of the anode pad 40. A pump 62 is connected to the vacuum conduit 46 for inducing a vacuum pressure in the vacuum head 44 through the vacuum conduit 46. The vacuum pressure induced in the vacuum head 44 by operation of the pump 62 ranges from typically about 50 p.s.i. to about 200 p.s.i. A filter 48 may be provided in the vacuum conduit 46 for purposes hereinafter described, and the vacuum conduit 46 is typically connected to the main electrolyte tank (not illustrated) of the ECMD system 28. The vacuum head 44 is typically capable of horizontal movement over the top surface of the anode pad 40, and this horizontal movement may be facilitated by an actuating motor 54 through an actuating arm 56 which is connected to the vacuum head 44. It is understood that a variety of mechanisms known by those skilled in the art may be used to effect bi-directional or multi-directional movement of the vacuum head 44 over the surface of the anode pad 40 to facilitate uniform application of vacuum pressure over the surface of the anode pad 40. In a preferred embodiment, the cleaning apparatus 30 is fitted with a brush or brushes 50, each having multiple bristles 52. In another embodiment of the ECMD system, generally indicated by reference numeral 58 in FIG. 3, the brush or brushes 50 of the cleaning apparatus 30 is/are omitted from the vacuum head 44.

The cleaning apparatus 30 is typically used between ECMD processing of multiple successive wafers in order to remove the particles 42 precipitated onto the upper surface of the anode pad 40 during the ECMD process. Accordingly, after removal of the processed wafer (not shown) from the anode pad 40, the vacuum head 44 is extended over the surface of the anode pad 40 by operation of the actuating motor 54 and actuating arm 56 or other actuating mechanism. Simultaneously, the pump 62 is operated to induce a vacuum, typically about 50 p.s.i. to about 200 p.s.i., in the vacuum conduit 46 and vacuum head 44 as the vacuum head 44 continually draws electrolyte solution (not shown) from the anode assembly 32, through the pores 41 in the anode pad 40 and into the vacuum head 44. The electrolyte solution, flowing through the pores 41 and along the surface of the anode pad 40 toward the vacuum head 44, initially dislodges the particles 42 from the anode pad 40 and then carries the dislodged particles 42 into the vacuum head 44. The bristles 52 of the brush 50 or brushes 50 simultaneously contact the upper surface of the anode pad 40 to assist the flowing electrolyte solution in dislodging the particles 42 from the anode pad 40 as the vacuum head 44 is moved over the surface of the anode pad 40 by operation of the actuating motor 54 and actuating arm 56 or other actuating mechanism. The electrolyte solution and dislodged particles 42 flow from the vacuum head 44, and through the vacuum conduit 46 and filter 48, which removes the particles 42 from the electrolyte solution flowing through the vacuum conduit 46. Finally, the vacuum conduit 46 distributes the filtered electrolyte solution back to the electrolyte tank (not illustrated) of the ECMD system 28, and the filtered electrolyte solution is eventually redistributed back to the anode assembly 32 for ECMD processing of additional wafers. The vacuum head 44 may be moved across the surface of the anode pad 40 as many times as is necessary to remove the particles 42 therefrom.

Figure 4:
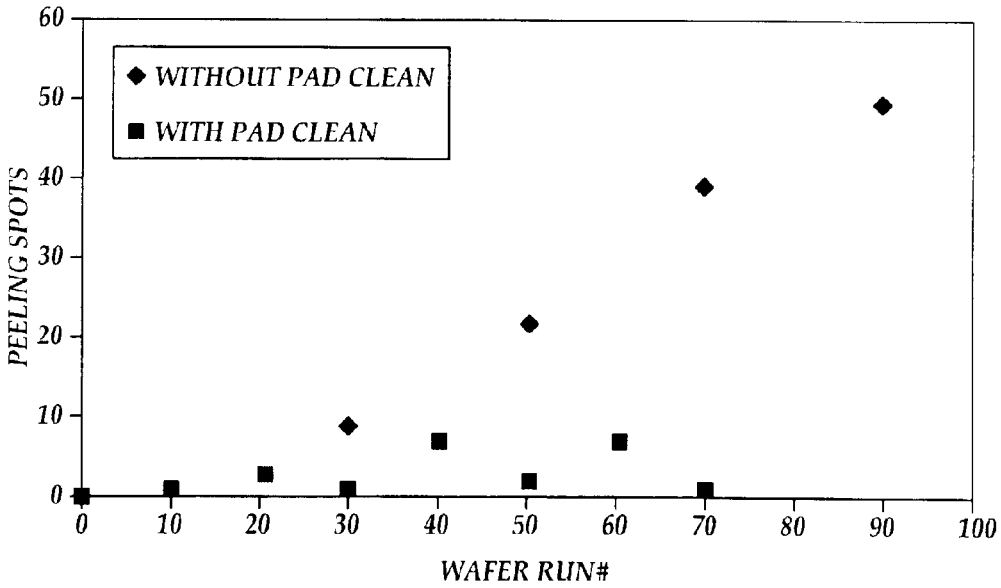
FIG. 4 is a graph illustrating the number of peeling spots (along the y-axis) remaining on each wafer (along the x-axis) after an ECMD process using a conventional ECMD system, as compared to using an ECMD system in implementation of the cleaning apparatus of the present invention.

The graph of FIG. 4 illustrates the number of peeling spots remaining on multiple wafers, plotted along the Y-axis, as a function of one set of wafers processed in a conventional ECMD system and another set of wafers processed in an ECMD system equipped with a cleaning apparatus of the present invention, plotted along the X-axis. The diamonds represent the wafers processed in the conventional ECMD system, and the squares represent the wafers processed in the ECMD system equipped with the apparatus of the present invention. It can be seen from the graph that the number of peeling spots induced on the processed wafers by the particles on the anode pad increased the longer the anode pad remained uncleaned. Regular implementation of the present invention between runs, however, significantly improved removal of particles from the anode pad of the ECMD system, as indicated by the reduction in peeling spots remaining on the wafers after each ECMD process.

While the preferred embodiments of the invention have been described above, it will be recognized and understood that various modifications can be made in the invention and the appended claims are intended to cover all such modifications which may fall within the spirit and scope of the invention.

Having described our invention with the particularity set forth above, we claim:

1. A cleaning apparatus for removing particles from a surface, comprising:

a vacuum head;

a vacuum conduit connected to said vacuum head;

a pump connected to said vacuum conduit for inducing a vacuum in said vacuum conduit and said vacuum head;

an actuating arm engaging said vacuum conduit; and an actuating motor operably engaging said actuating arm for moving said vacuum head across the surface.

2. The cleaning apparatus of claim 1 further comprising a filter connected to said vacuum conduit.

3. A cleaning apparatus for removing particles from a surface, comprising:

a vacuum head;

at least one brush carried by said vacuum head for dislodging the particles from the surface;

a vacuum conduit connected to said vacuum head;

a pump connected to said vacuum conduit for inducing a vacuum in said vacuum conduit and said vacuum head;

an actuating arm engaging said vacuum conduit; and an actuating motor operably engaging said actuating arm for moving said vacuum head across the surface.

4. The apparatus of claim 3 further comprising a filter connected to said vacuum conduit.

5. A method of removing particles from an anode pad of an electrochemical mechanical deposition system containing an electrolyte solution beneath the anode pad, said method comprising the steps of:

providing a vacuum head;

providing a pump in fluid communication with said vacuum head;

positioning said vacuum head in adjacent relationship to the anode pad; and inducing vacuum pressure in said vacuum head by operating said pump, whereby the electrolyte solution is drawn through the anode pad, dislodges the particles from the anode pad and enters said vacuum head with the particles.

6. The method of claim 5 further comprising the steps of providing at least one brush on said vacuum head and dislodging the particles from the anode pad by operation of said at least one brush.

7. The method of claim 5 further comprising the step of moving said vacuum head over the anode pad during said operating said pump.

8. The method of claim 7 further comprising the steps of providing at least one brush on said vacuum head and dislodging the particles from the anode pad by operation of said at least one brush.

9. The method of claim 5 further comprising the steps of providing a filter in fluid communication with said vacuum head and removing the particles from the electrolyte solution by distributing the electrolyte solution through said filter.

10. The method of claim 9 further comprising the steps of providing at least one brush on said vacuum head and dislodging the particles from the anode pad by operation of said at least one brush.

11. The method of claim 9 further comprising the step of moving said vacuum head over the anode pad during said operating said pump.

12. The method of claim 11 further comprising the steps of providing at least one brush on said vacuum head and dislodging the particles from the anode pad by operation of said at least one brush.

13. The method of claim 5 wherein said inducing a vacuum pressure in said vacuum head comprises the step of inducing a vacuum pressure having a suction force of from about 50 p.s.i. to about 200 p.s.i. in said vacuum head by operating said pump.

14. The method of claim 13 further comprising the steps of providing at least one brush on said vacuum head and dislodging the particles from the anode pad by operation of said at least one brush.

15. The method of claim 13 further comprising the step of moving said vacuum head over the anode pad during said operating said pump.

16. The method of claim 13 further comprising the steps of providing a filter in fluid communication with said vacuum head and removing the particles from the electrolyte solution by distributing the electrolyte solution through said filter.

* * * * *